US006360400B1

(12) United States Patent
Chang

(10) Patent No.: US 6,360,400 B1
(45) Date of Patent: Mar. 26, 2002

(54) CONTROLLING DEVICE FOR RETRACTABLE WHEELS OF A LUGGAGE BARROW

(76) Inventor: Fu-Jung Chang, 8-5 Fl., No. 191, Fu-Hsing N. Rd., Taipei (TW)

( * ) Notice: Subject to any disclaimer, the term of this patent is extended or adjusted under 35 U.S.C. 154(b) by 0 days.

(21) Appl. No.: 09/537,981

(22) Filed: Mar. 29, 2000

(30) Foreign Application Priority Data

Feb. 22, 2000 (TW) ..... 89202822

(51) Int. Cl.[7] ..... A47B 95/02

(52) U.S. Cl. ..... 16/113.1; 16/34; 280/37; 280/655; 190/18 A; 190/115

(58) Field of Search ..... 16/113.1, 405, 16/429, 33, 34, 19; 280/652, 655, 655.1, 47.315, 47.371, 37; 190/18 A, 39, 115; 301/1, 111.05, 125

(56) References Cited

U.S. PATENT DOCUMENTS 4,761,012 A * 8/1988 Dames ..... 280/655
5,636,733 A * 6/1997 Marchwiak ..... 190/18 A
5,664,652 A * 9/1997 Shamah ..... 190/18 A
6,134,748 A * 10/2000 Kuo ..... 16/35 R
6,196,366 B1 * 3/2001 Lin ..... 190/18 A

* cited by examiner

*Primary Examiner*—Chuck Y. Mah
(74) *Attorney, Agent, or Firm*—Thorp Reed & Armstrong LLP

(57) ABSTRACT

A controlling device for retractable wheels of a luggage barrow includes a housing with a telescopic handle assembly provided at a back side thereof, an L-shaped plate secured on a bottom end of the back side thereof, two wheel brackets respectively pivotally connected with the L-shaped plate and having two wheels pivotally connected at lower ends thereof, two linkages respectively linked with the wheel brackets, and two springs respectively provided in the linkages. An inner plate is provided on an inner side of the housing and fixed with the L-shaped plate. A connecting bar is extended through the lower ends of the telescope handle assembly. Two pressing members respectively have two upper ends thereof pressed against upper ends of the linkage member and two lower ends thereof respectively connected with two opposite ends of the connecting bar, whereby the wheels are able to be retracted into or extended out of the housing by retracting or pulling up the telescope handle assembly.

8 Claims, 8 Drawing Sheets

CONTROLLING DEVICE FOR RETRACTABLE WHEELS OF A LUGGAGE BARROW

BACKGROUND OF THE INVENTION

1. Field of the Invention

The present invention relates to a controlling device for retractable wheels of a luggage barrow, particularly to a controlling device which is able to make the wheels retract by retracting a telescopic handle assembly of the luggage barrow.

2. Description of Related Art

People increasingly have more and more opportunities to travel around far and near. Various luggage barrows have appeared on the market to meet different needs of customers, and corresponding patents are already available in this field. Patents such as U.S. Pat. Nos. 5,400,472; 5,553,350; 5,367,743: 5,371,923; U.S. patent application Ser. Nos. 09/273,851; 09/401,003; and 09/453,666 filed by the same applicant of the present invention . . . etc. all describe luggage carriers of different types.

There is one type of luggage barrow having a telescopic handle assembly and a pair of wheels rotatably provided at lower ends of the handle assembly. This type of luggage barrow is conveniently towed upon the wheels by pulling upon the extended telescopic handle assembly. The telescopic handle assembly is easily retracted when needed by a user. However, the wheels always protrude from the luggage barrow which may sometimes cause trouble to users.

Therefore, it is an objective of the invention to provide a controlling device for retractable wheels of a luggage barrow to mitigate and/or obviate the aforementioned problems.

SUMMARY OF THE INVENTION

The object of the present invention is to provide a controlling device for retractable wheels of a luggage barrow, wherein the wheels can be retracted in a housing of the luggage barrow via the controlling device actuated by a telescopic handle assembly of the luggage barrow.

Other objects, advantages and novel features of the invention will become more apparent from the following detailed description when taken in conjunction with the accompanying drawings.

The detailed features of the present invention will be apparent in the detailed description with appropriate reference to the accompanying drawings.

DETAILED DESCRIPTION OF THE PREFERRED EMBODIMENT

Figure 1:
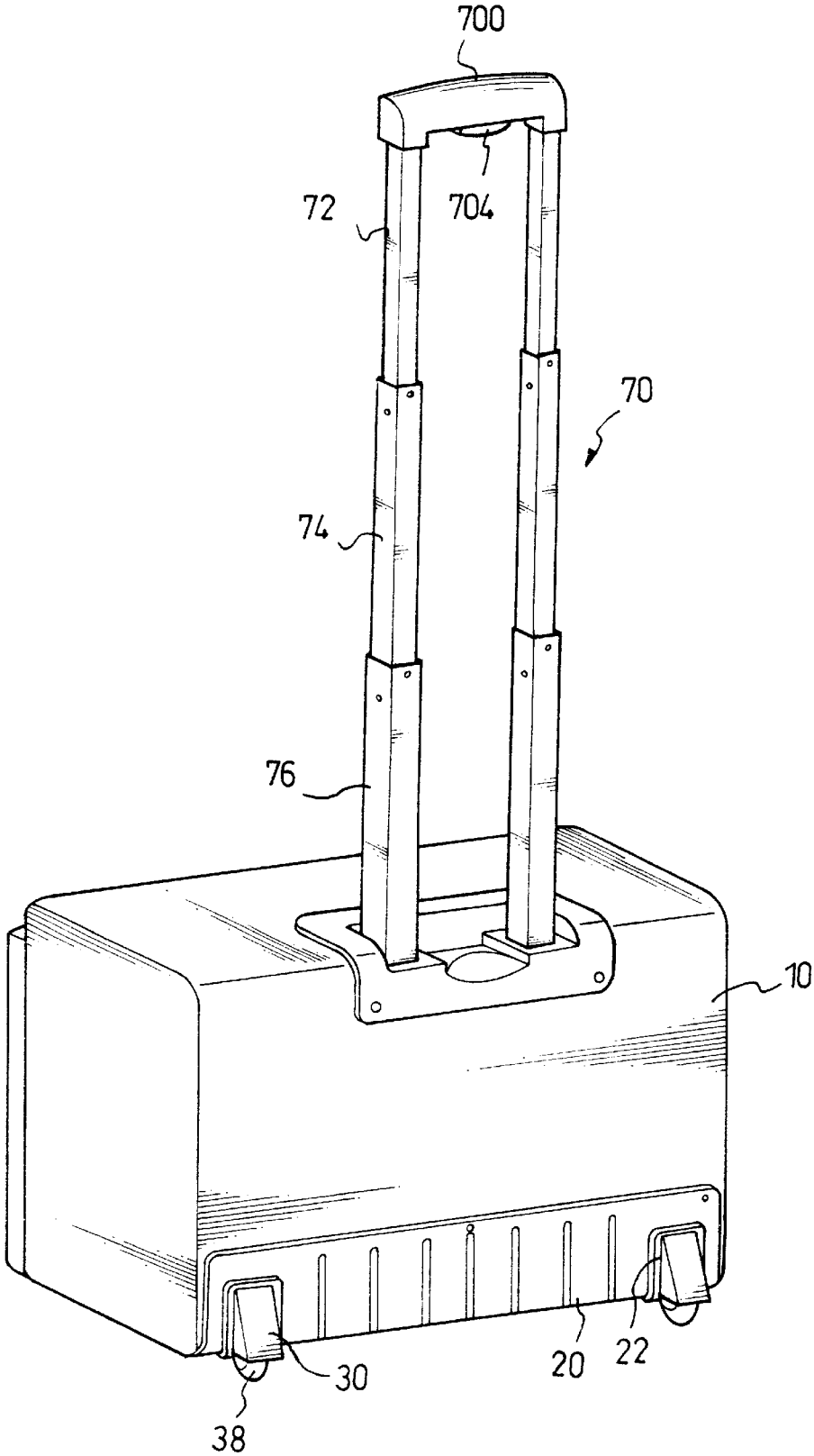
FIG. 1 is a perspective view of a luggage barrow provided with a controlling device for retractable wheels in accordance with the present invention.

As shown in FIG. 1, the present invention relates to a controlling device for retractable wheels of a luggage barrow comprising a housing (10), which has a telescopic handle assembly (70) provided at a back side thereof, an L-shaped plate (20) secured on a bottom end of the back side thereof, wherein the telescopic handle assembly (70) includes a pair of first pull-rods (72) with a handle bar (700) provided between two top ends thereof and a control button (704) provided at the center of the handle bar (700), a pair of second pull-rods (74), a pair of third pull-rods (76) and a pair of fourth rods (78) (see FIG. 3) which are fixed in the housing (10).

Figure 2:
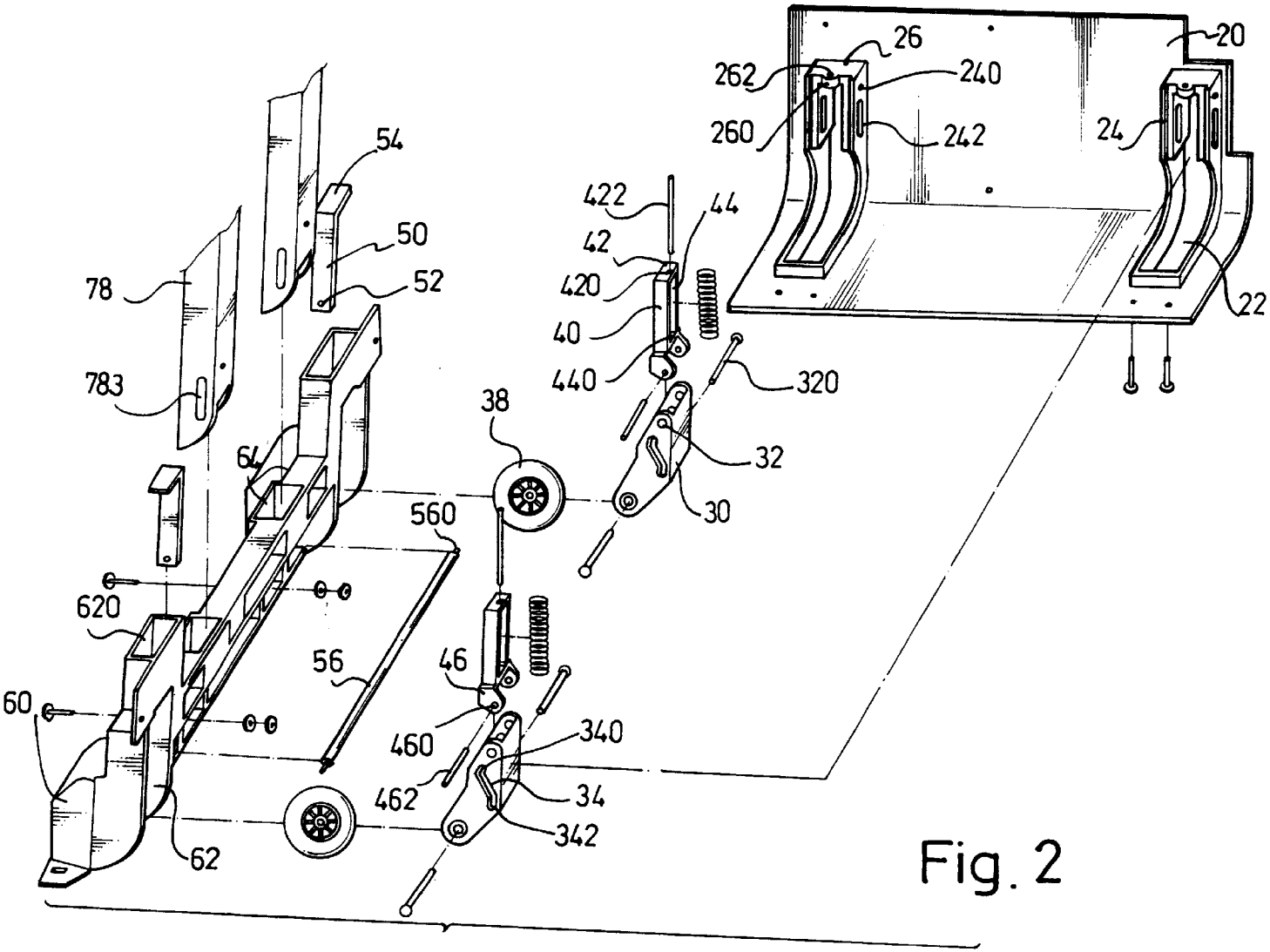
FIG. 2 is an exploded view of the controlling device for the retractable wheels in accordance with the present invention.
Figure 4:
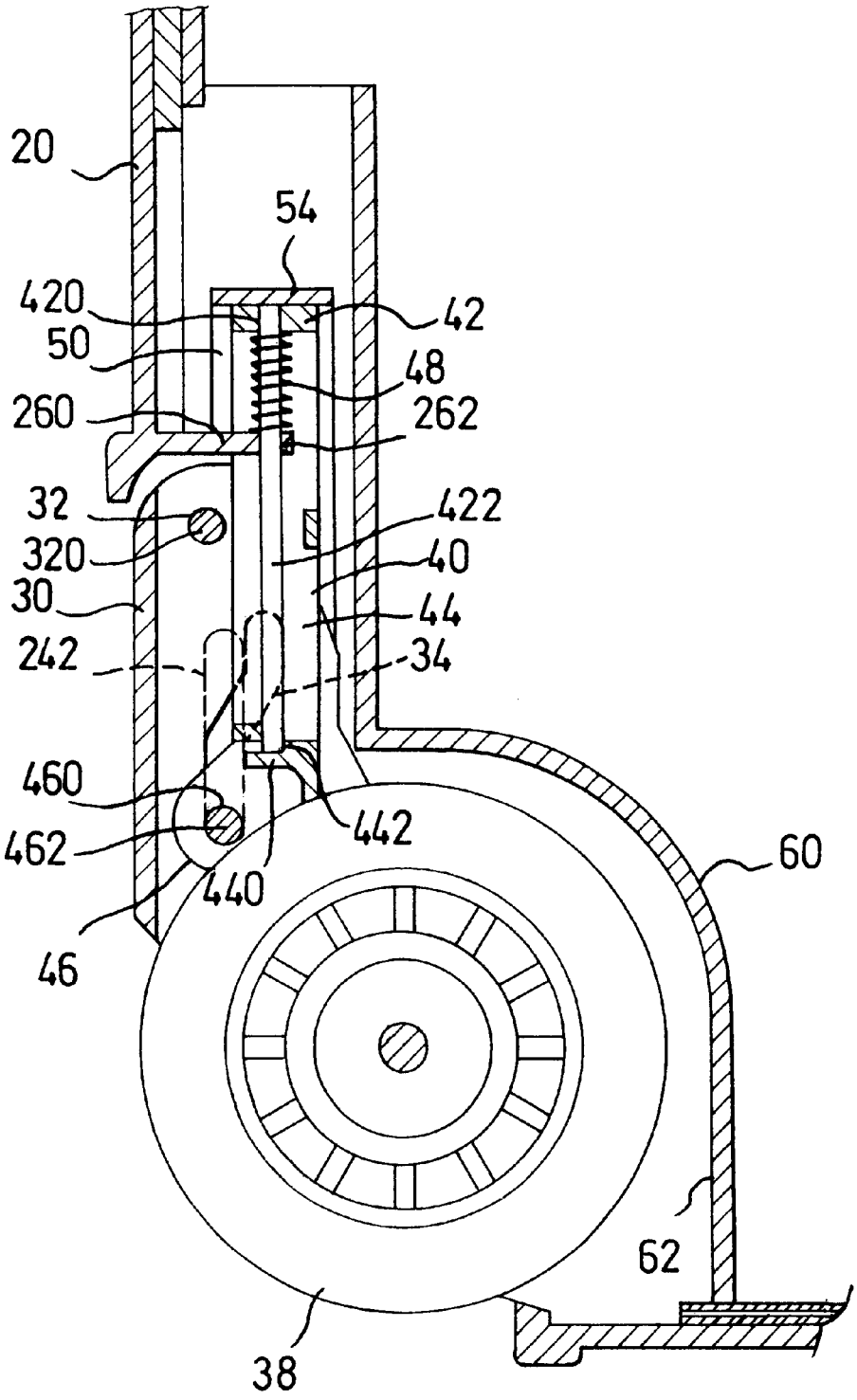
FIG. 4 is a partial cross sectional side view of the controlling device for the retractable wheels in accordance with the present invention, showing the wheels are retracted in the housing.

As best shown in FIGS. 2 and 4, the controlling device for the retractable wheels of the luggage barrow has most elements thereof assembled on the L-shaped plate (20) and a corresponding inner plate (60) provided on an inner side of the housing (10) and securely fixed with the L-shaped plate (20). The L-shaped plate (20) has two openings (22) defined therein. Opposite sides of each opening (22) are integrally formed with two side pieces (24) having two pivot holes (240) respectively defined therein to be pivotally connected with two wheel brackets (30), and two straight slots (242) respectively defined therein and opposed to each other. Upper ends of the two openings (22) respectively have two pressing pieces (26) formed thereon with two lugs (260) extending outwards. Each lug (260) has a hole (262) defined therein.

Each wheel bracket (30) has opposite sides of an upper end thereof defined with two pivot holes (32) therein corresponding to the two pivot holes (240) of the side pieces (24), whereby the wheel brackets (30) are pivotally connected with the side pieces (24) of the two openings (22) by two pivots (320) respectively extending through the pivot holes (32) and corresponding pivot holes (240). Two bent slots (34) are respectively defined in the opposite sides of the wheel bracket (30). Each bent slot (34) has an upper bent portion (340) and a lower bent portion (342). Two wheels (38) are respectively and pivotally connected with lower ends of the wheel brackets (30).

Two linkages (40) are formed as frame members and each has an upper sheet (42) with a hole (420) defined therein, a space (44) defined in the center thereof, a lower sheet (440) with a receiving recess (442) defined therein, and two ears (46) respectively formed at opposite ends of the lower sheet (440). Each ear (46) has a pin hole (460) defined therein. Lower ends of the two linkages (40) are respectively received in the bracket (30), and the lugs (260) of the L-shaped plate (20) are respectively extended into the corresponding spaces (44) of the linkages (40). Two springs (48) are respectively provided in the spaces (44) of the linkages (40) and compressed between the upper sheet (42)

and the corresponding lugs (260). Two rods (422) have upper ends thereof respectively extended into the holes (420) of the upper sheets (42) and lower ends thereof extended through the springs (48), the holes (262) of the lugs (260) and are pressed against walls defining the receiving recesses (442) of the lower sheets (440). Two pins (462) are respectively extended through the straight slots (242), corresponding bent slots (342) and pin holes (460) of the linkages (40), whereby the linkages (40) are respectively linked with the wheel brackets (30). When the pins (462) move upwards or downwards along the straight slots (242) and the bent slots (342), the brackets (30) are retracted in the housing (10) or extended out of the housing (10).

Figure 7:
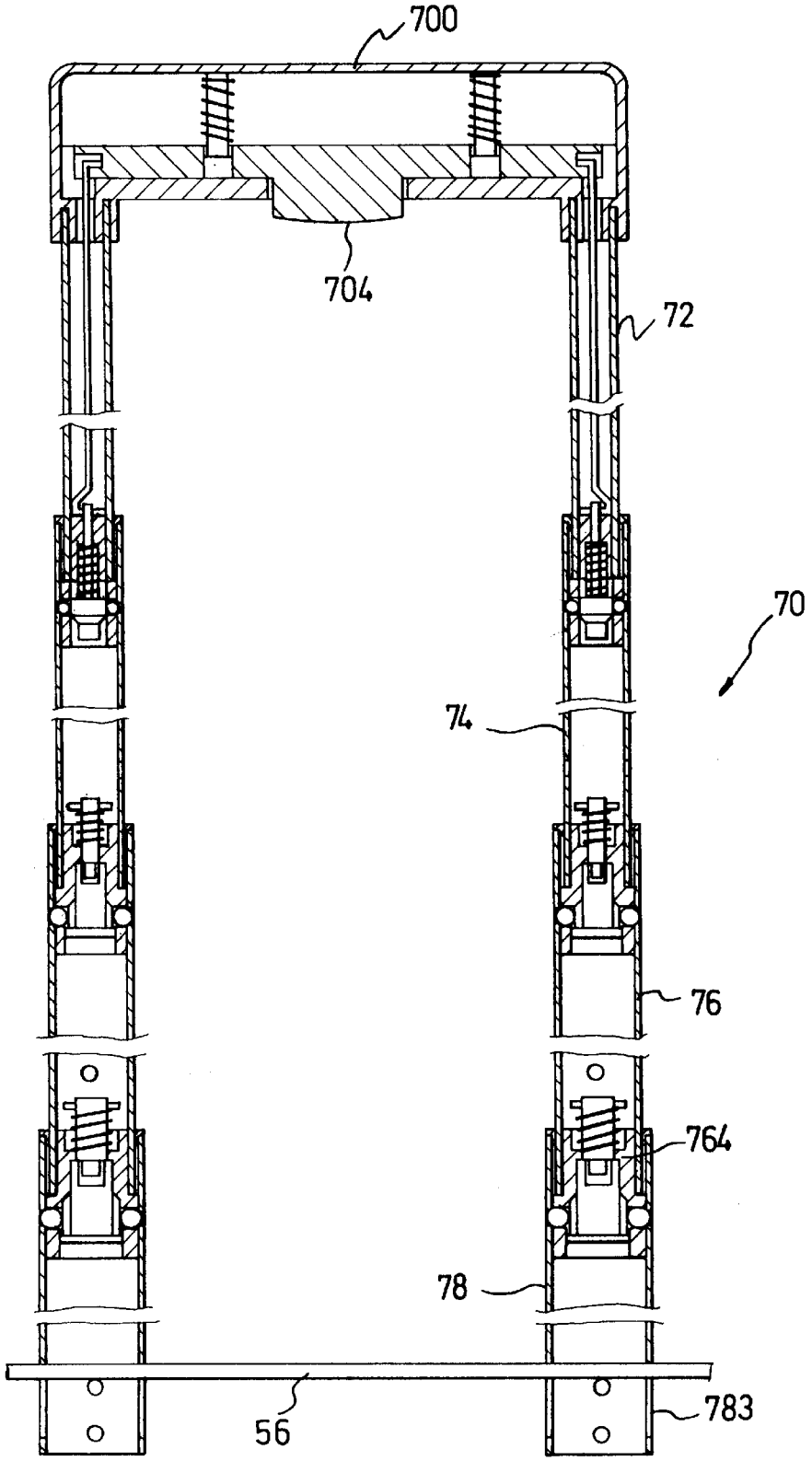
FIG. 7 is a partial cross sectional front view of a telescopic handle of the luggage barrow in accordance with the present invention.
Figure 8:
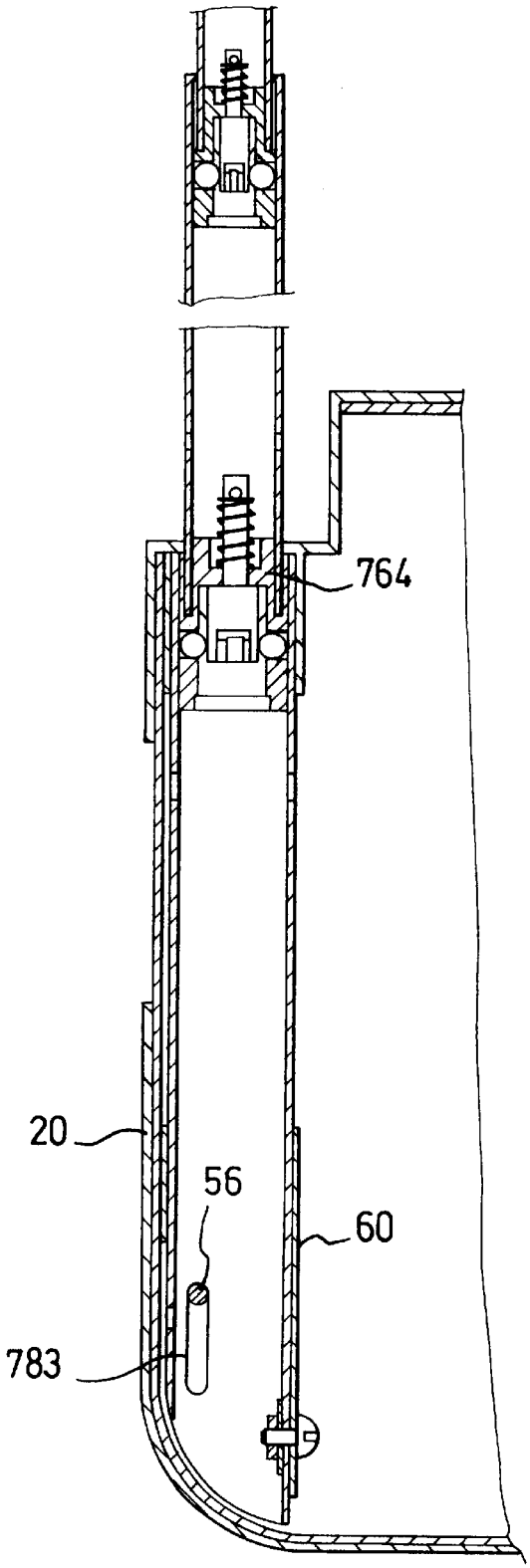
FIG. 8 is a partial cross sectional side view of the telescopic handle of the luggage barrow in accordance with the present invention.

The inner plate (60) is defined with two wheel recesses (62) corresponding to the two openings (22) of the L-shaped plate (20). The L-shaped plate (20) is securely fixed with the inner plate (60); the side walls (24) of the openings (22) are received in the wheel recesses (62); and the wheels (38) pivotally connected with the wheel brackets (30) are retractable in the wheel recesses (62). The inner plate (60) has two assembling holes (620) defined therein respectively communicating with the wheel recesses (62) to receive the linkages (40) therein, and two through holes (64) defined therein to receive lower ends of the fourth rods (78) extending therethrough. Two pressing members (50) respectively provided in the assembling holes (620) have two lower ends thereof respectively defined with two eyes (52) therein and two upper ends thereof respectively formed with two bent portions (54) which are respectively pressed against the upper sheets (42) of the linkages (40). Referring to FIGS. 7 and 8, a connecting bar (56) extended through vertical slots (783) defined at opposite sides of the fourth rods (78) has two opposite ends thereof formed with two neck ends (560) respectively fixed into the eyes (52) of the pressing members (50).

Figure 3:
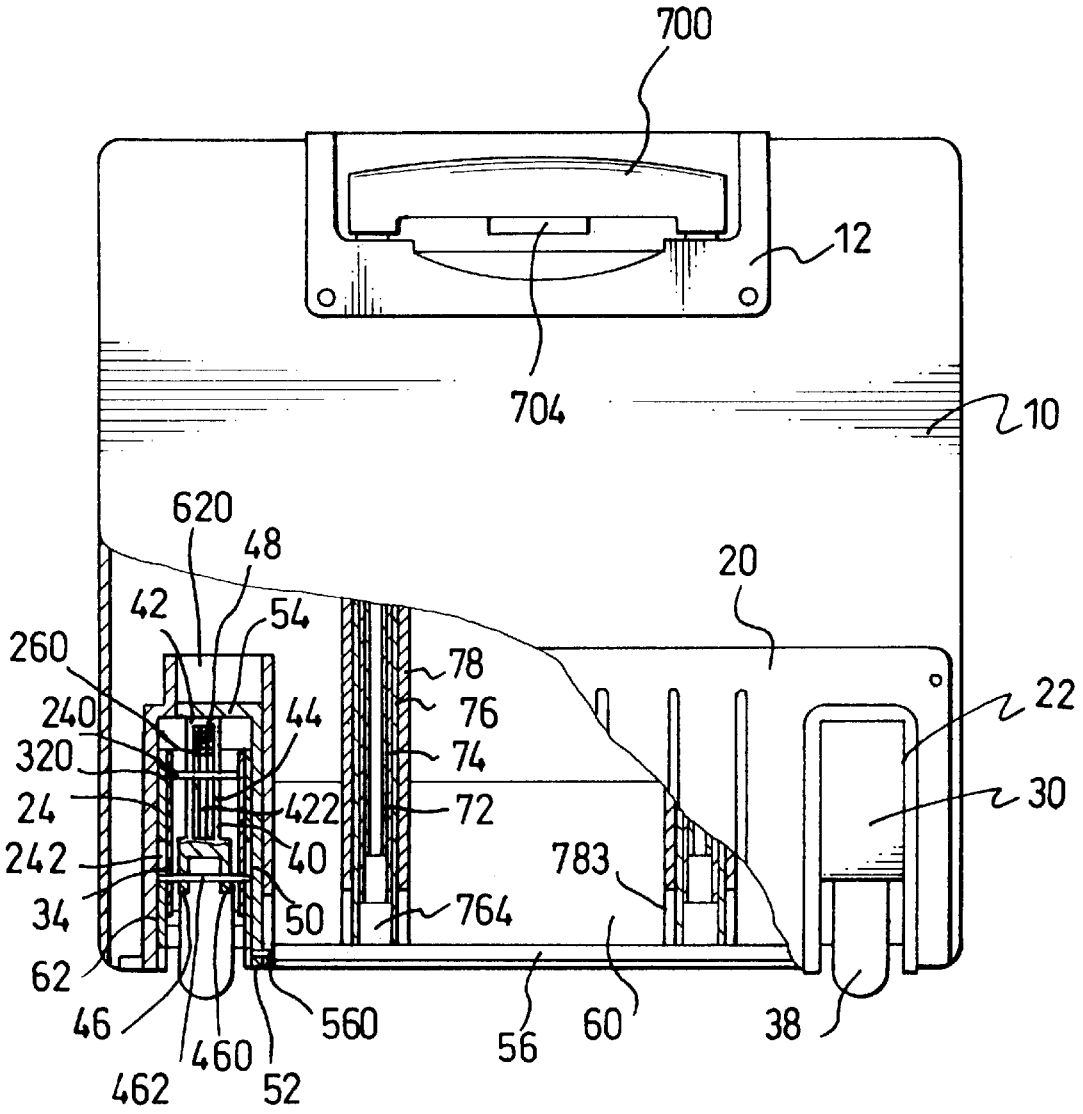
FIG. 3 is a partial cross sectional front view of the controlling device for the retractable wheels in accordance with the present invention, showing the wheels are retracted in a housing of the luggage barrow.

As shown in FIGS. 3 and 4, when the handle assembly (70) is completely retracted, two lower inner tubes (764) provided in lower ends of the third pull-rods (76) press the connecting bar (56) downwards. The pressing members (50) are drawn downwards by the connecting bar (56). Then the linkages (40) pressed by the pressing members (50) respectively move downwards, and the springs (48) are respectively compressed between the upper sheets (42) and the lugs (260). As the pins (462) connected with the linkages (40) respectively move downwards along the straight slots (242) and the bent slots (34) from tops of the upper bent portions (340) to bottoms of the lower bent portions (342), the wheel brackets (30) are pivotally turned inwards, and the wheels (38) are retracted into the wheel recesses (62).

Figure 5:
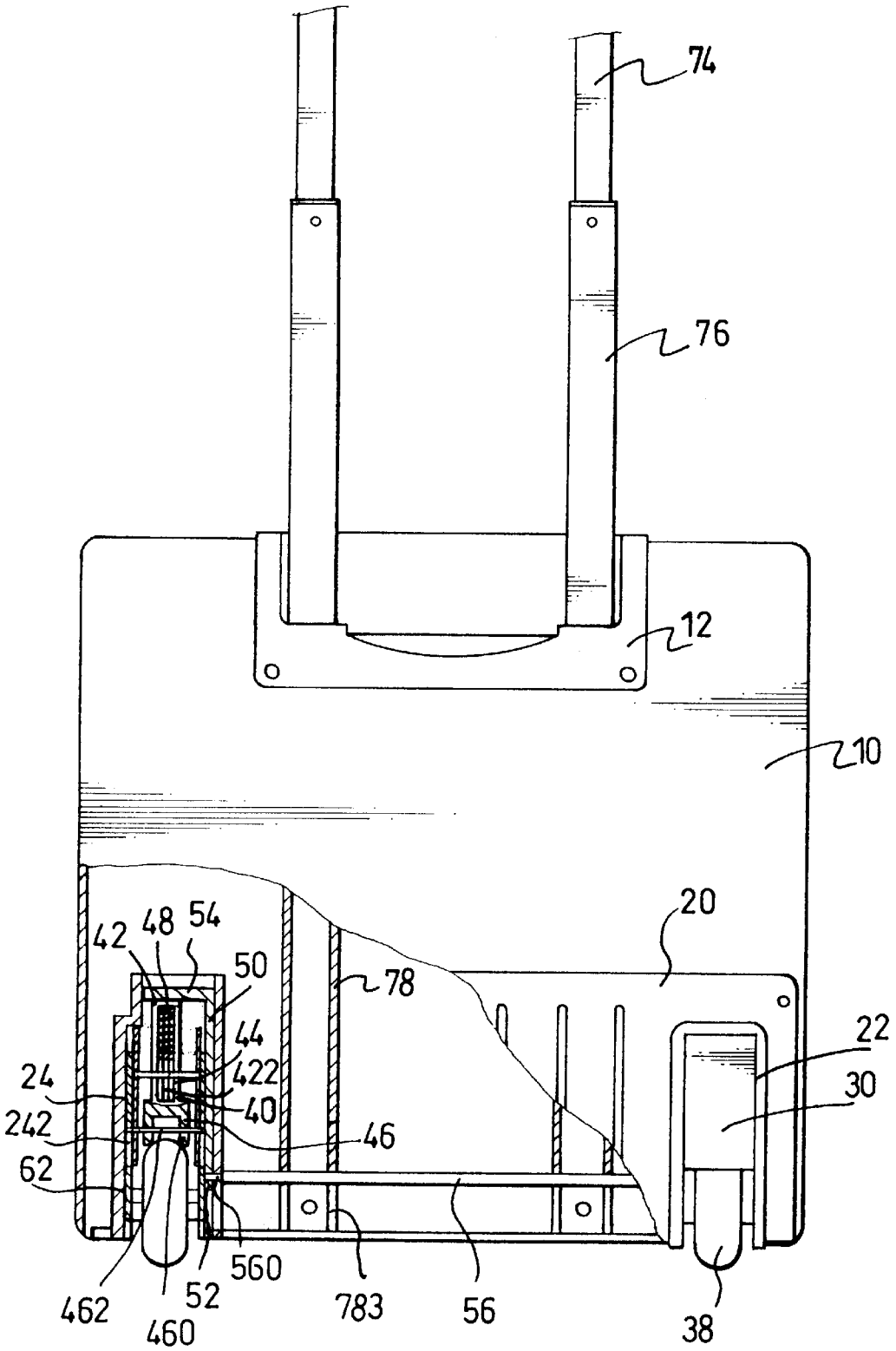
FIG. 5 is a partial cross sectional front view of the controlling device for the retractable wheels in accordance with the present invention, showing the wheels are extended out of the housing.
Figure 6:
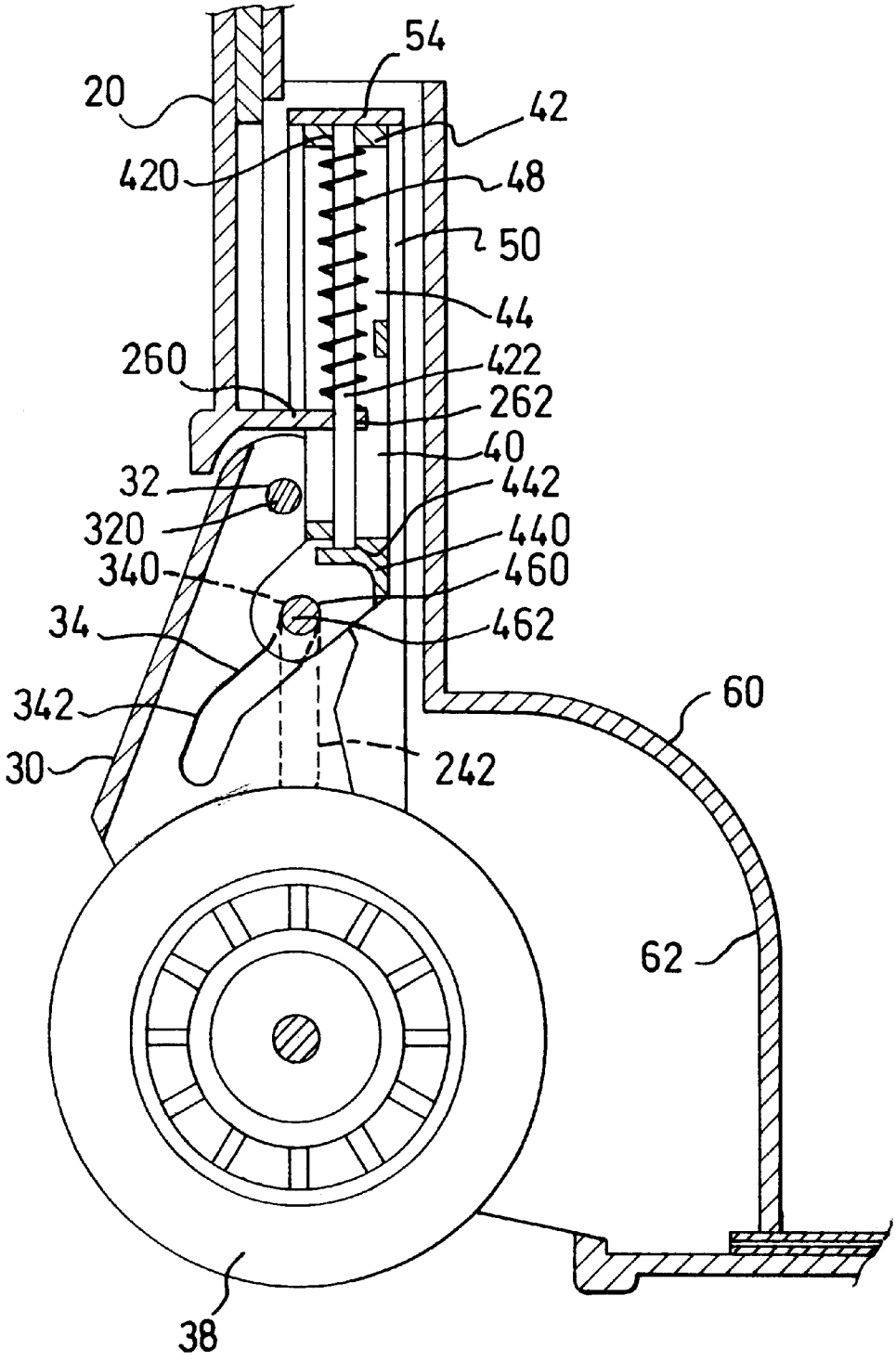
FIG. 6 is a partial cross sectional side view of the controlling device for the retractable wheels in accordance with the present invention, showing the wheels are extended out of the housing.

Now referring to FIGS. 5 and 6, when the handle assembly (70) is pulled up, the lower ends of the lower inner tubes (764) are separated from the connecting bar (56). The pressing members (50) and the linkages (40) are respectively moved upward by a pressing force of the springs (48), and then the pins (462) connected with the linkage members (40) respectively move upwards along the straight slots (242) and the bent slots (34) from the bottoms of the lower bent portions (342) to the tops of the upper bent portions (340), whereby the wheel brackets (30) are pivotally turned outwards, and the wheels (38) are extended out of the wheel recesses (62).

When the pins (462) of the linkages (40) move into the bottoms of the lower bent portions (342) or the tops of the upper bent portions (340), as the lower bent portions (342) and the upper bent portions (340) of the bent slots (34) are superposed to the straight slots (242) along their lengths, the pins (462) are fixedly limited in the lower and upper bent portions (340, 342) and the straight slots (242), and so the wheels (38) are fixed in their extended or retracted position without any side play.

FIGS. 7 and 8 illustrate how the telescopic assembly (70) is comprised, however as that assembly does not form part of the claimed invention and is known to those skilled in the art, further description thereof is omitted.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A controlling device for retractable wheels of a luggage barrow having a housing (10) which has a telescope handle assembly (70) provided at a back side thereof, the controlling device comprising:

an L-shaped plate (20) secured on a bottom end of the back side of the housing (10) and defining two openings (22) therein;

two wheel brackets (30) respectively formed with upper ends thereof pivotally connected with the L-shaped plate (20) at the openings (22) and lower ends thereof pivotally connected with two wheels (38);

two linkages (40) respectively linked with the wheel brackets (30);

two springs (48) respectively provided in the linkages (40);

an inner plate (60) provided on an inner side of the housing (10) and fixed with the L-shaped plate (20), said inner plate (60) having two wheel recesses (62) defined therein corresponding to the openings (22), and two through holes (64) defined therein to receive lower ends of the telescope handle assembly (70);

a connecting bar (56) extended through the lower end of the telescope handle assembly (70); and two pressing members (50) respectively comprising two upper ends thereof formed with two bent portions (54) pressed against upper ends of the linkage member (40), and two lower ends thereof respectively connected with two opposite ends of the connecting bar (56);

whereby the wheels (38) connected with the wheel brackets (30) are able to be retracted into or extended out of the housing (10) via the pressing members (50) actuated by the telescope handle assembly (70).

2. The controlling device as claimed in claim 1, wherein the telescopic handle assembly (70) includes a pair of first pull-rods (72) with a handle bar (700) provided therebetween and a control button (704) provided at the center of the handle bar (700), a pair of second pull-rods (74), a pair of third pull-rods (76), and a pair of fourth rods (78) fixed in the housing (10).

3. The controlling device as claimed in claim 2, wherein the fourth rods (78) both include a lower end with two opposed sides, each said opposed side defining a vertical slot (783).

4. The controlling device as claimed in claim 1, wherein each opening (22) of the L-shaped plate (20) has two side pieces (24) integrally formed thereon to pivotally connect with the wheel bracket (30) by two pivots (320) respectively extending through pivot holes (240) defined in the two side pieces (24) and two corresponding pivot holes (32) defined in opposite walls of the wheel bracket (30).

5. The controlling device as claimed in claim 1, wherein each opening (22) of the L-shaped plate (20) comprises two opposite side pieces (24), each said side piece (24) defining a straight slot (242) therein, opposite sides of the wheel brackets (30) defining two bent slots (34) therein, and two pins (462) respectively extending g through the straight slots (242), the bent slots (34) and two pin holes (462) defined in opposite sides of the linkage members (40).

6. The controlling device as claimed in claim 5, wherein each bent slot (34) of the wheel bracket (30) has an upper bent portion (340) and a lower bent portion (342), whereby when the pins (462) move into lower ends of the lower bent portions (342) or upper ends of the upper bent portions (340), the lower bent portions (342) and the upper bent portions (340) of the bent slots (34) are superposed to the straight slots (242) along their lengths.

7. The controlling device as claimed in claim 1, wherein each linkage member (40) has an upper sheet (42) with a hole (420) defined therein, a space (44) for receiving the spring (48) therein and a lower sheet (440) with a receiving recess (442) defined therein;

the L-shaped plate (20) forming two pressing pieces (26) at upper ends of the openings (22), each pressing pieces (26) having a lug (260) extending into a corresponding space (44); two pins (422) respectively extending though the holes (420) of the upper sheets (42), the springs (48), holes (262) defined in the lugs (26) and receiving recesses (442) of the lower sheet (440).

8. The controlling device as claimed in claim 1, wherein the connecting bar (56) has opposite ends thereof respectively formed as two neck portions (560) inserted into two eyes (52) defined in lower ends of the L-shaped pressing members (50).

* * * * *